US005674166A

United States Patent [19]

Gordon

[11] Patent Number: 5,674,166

[45] Date of Patent: Oct. 7, 1997

[54] ISOTONIC OR ISOMETRIC EXERCISE AND THERAPY SYSTEM

[75] Inventor: James R. Gordon, Benton, Ill.

[73] Assignee: Gordon Research & Development, Inc., Pinckneyville, Ill.

[21] Appl. No.: 736,293

[22] Filed: Oct. 24, 1996

(Under 37 CFR 1.47)

Related U.S. Application Data

[60] Division of Ser. No. 376,385, Jan. 23, 1995, which is a continuation-in-part of Ser. No. 364,280, Dec. 27, 1994, Pat. No. 5,417,407.

[51] Int. Cl.[6] ..... A63B 21/02

[52] U.S. Cl. ..... 482/127; 482/123

[58] Field of Search ..... 482/127, 126, 482/44, 123, 129

[56] References Cited

U.S. PATENT DOCUMENTS

| | | | |
|---|---|---|---|
| 3,246,893 | 4/1966 | Boggild et al. | 482/33 |
| 3,834,695 | 9/1974 | Boggild et al. | 482/33 |
| 3,942,790 | 3/1976 | Rice | 482/91 |
| 4,326,692 | 4/1982 | Loomer | 248/488 |
| 4,482,193 | 11/1984 | Boggs et al. | 305/51 |
| 4,620,704 | 11/1986 | Shifferaw | 482/130 |

*Primary Examiner*—Lynne A. Reichard

*Attorney, Agent, or Firm*—Dorn, McEachran, Jambor & Keating

[57] ABSTRACT

This isometric/isotonic exercise and physical therapy system is based on a series of elongated exercise rods made of urethane or other resilient, elastomeric resin that is both bendable and twistable. The exercise or therapy afforded by the system depends on the resilient exercise rod or rods; for a relatively limp, low-resistance rod the exercise is essentially isotonic, but with stiffer rods isometric exercise or therapy is provided. The system includes devices that mount the rod or rods on the person using the system for varied exercises of the knee, elbow, hip, wrist, back, or virtually any other portion of the user's anatomy.

5 Claims, 6 Drawing Sheets

ISOTONIC OR ISOMETRIC EXERCISE AND THERAPY SYSTEM

This application is a division of Ser. No. 08/376,385 filed Jan. 23, 1995, pending which was a continuation-in-part of Ser. No. 08/364,280 filed Dec. 27, 1994, now U.S. Pat. No. 5,417,407.

BACKGROUND OF THE INVENTION

This invention is directed to a versatile system of devices for isometric or isotonic exercise and physical therapy. The invention has many of the operational attributes of the exercise and physical therapy apparatus described and claimed in the applicant's co-pending U.S. applications entitled "Exercise and Therapy Apparatus", and "Isotonic/Isometric Device for Exercise and Physical Therapy", Ser. Nos. 08/364,280 and 08/364,281, both filed Dec. 27, 1994, though the earlier inventions are rather different in structure. This invention usually uses a solid or tubular urethane rod of circular cross section as the principal exercise element, but can utilize a flat plate, a rectangular rod, or the adjustable elastomer torsion device described and claimed in the applicant's co-pending U.S. patent application for "Adjustable Elastomer Torsion Device", Ser. No. 08/262,511, filed Jun. 20, 1994.

A wide variety of different mechanisms have been devised for use in physical therapy for various parts of the human anatomy. Typically, an injured or otherwise impaired arm or wrist requires exercise (physical therapy) to enable the impaired person to recover from the impairment. The same situation may apply to a leg, an ankle, a foot, a back, or some other part of the human anatomy. For some impairments, particularly those involving broken bones, isometric exercises affording substantial resistance are preferred. In trainer's jargon, "no pain, no gain". For other impairments, such as those entailing muscular inflammation, zero or near-zero progressive resistance (isotonic) exercise is often deemed preferable. Many mechanisms can be used for both exercise and therapy purposes. It is difficult, if not impossible, to distinguish between their exercise and therapy attributes.

A principal problem with many exercise and physical therapy devices and systems has been that they usually are not sufficiently versatile to meet the numerous different physical problems to which human beings are prone and to provide either isotonic or isometric exercise, at a desired level, for a given part of the human anatomy. Sometimes this problem is overcome, at least in part, by appropriate provision for changing the component parts of a device to suit the needs of the person requiring exercise or physical therapy. Changeover of this kind may be difficult and time consuming, particularly in a complex exercise device. Furthermore, due to the wide disparity of individual humans as regards their physical attributes such as strength, weight, size, degree of impairment, etc., an apparatus that is quite appropriate and suitable for use by one individual may be totally unacceptable to another person having the same basic impairment, regardless of modification of the device. That is, a therapeutic exercise device may be lacking in the versatility necessary for conversion to use by different individuals even though those individuals have the same basic impairment.

SUMMARY OF THE INVENTION

It is a principal object of the present invention, therefore, to provide a new and improved isotonic/isometric physical therapy and exercise system that can be readily and inexpensively adapted to a broad variety of individuals having quite different physical characteristics.

Another object of the invention is to provide a new and improved isotonic/isometric exercise and physical therapy system that provides bending, twisting, and other exercises over a broad range of resistance levels, while maintaining construction and use costs at a minimum.

Accordingly, one aspect of the invention relates to an isotonic/isometric physical therapy and exercise system for use in the performance of exercises by a human being having an impairment subject to improvement by such exercises, which exercises entail bending or twisting of the impairment. The system comprises a plurality of elongated, resilient, bendable and twistable elastomeric exercise rods, formed of an elastomer such as urethane, with each of the rods in the system having different resilience/resistance characteristics.

In another aspect, the invention relates to an isotonic/isometric physical therapy and exercise device for use in the performance of exercises by a human being having an impairment subject to improvement by such exercises. The physical therapy and exercise device comprises an elongated, resilient, bendable and twistable elastomeric exercise rod formed of an elastomer such as urethane. A first clamp is mounted on one end of the rod, the first clamp including a first securing means (such as a strap) for securing the one end of the rod to the anatomy of a human user at a location on one side of the impairment. A second clamp is mounted on the other end of the rod, the second clamp including a second securing means (such as a strap), for securing the other end of the rod to the anatomy of the human user at a location on the other side of the impairment.

DESCRIPTION OF THE PREFERRED EMBODIMENTS

Figure 1:
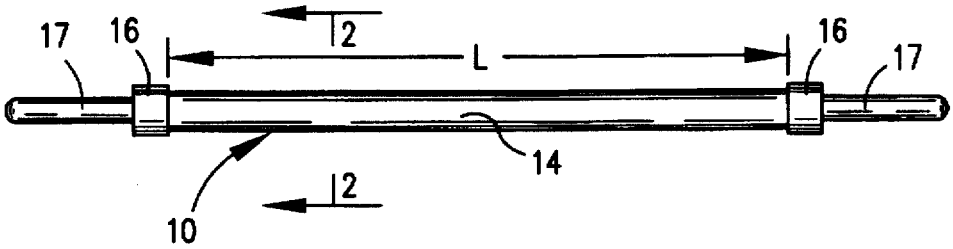
FIG. 1 is an elevation view of an isotonic/isometric exercise and therapy device for one embodiment of the invention.
Figure 2B:
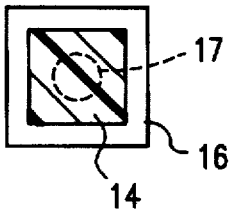
FIGS. 2A and 2B are section views, taken approximately along line 2—2 in FIG. 1.
Figure 2A:
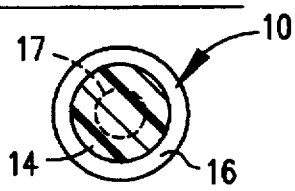

FIGS. 1 affords an elevation view of an isotonic/isometric physical therapy and exercise device 10 used in a first preferred embodiment of the system of the present invention. Device 10 comprises elongated exercise rod 14. Exercise Rod 14 is of resilient, bendable, twistable elastomeric construction; the exercise rod may be solid in cross section or may be tubular. The cross section of rod 14 as shown in FIG. 2A is circular, but the rod may be square in cross section as illustrated in FIG. 2B. Other acceptable cross-sectional configurations for rod 14 are rectangular, hexagonal, and elliptical; indeed, virtually any other desired shape may be used. Each end of exercise rod 14, as seen in FIG. 1, is equipped with a rigid handle 17 that projects outwardly beyond the effective length L1 of the exercise rod. Handles 17 are secured to the ends of rod 14 by two collars 16. Each collar 16 in FIG. 2A is annular; in FIG. 2B it is square. Any desired relatively rigid material, such as metal or wood, may be used for handle 17.

Device 10 can be used for either isotonic or isometric exercises. A principal determining factor, with respect to the nature of the exercise employed, is the bending twisting resistance of exercise rod 14. If rod 14 is of relatively soft construction, such as a tubular urethane rod having a diameter of approximately 1.5 inches (4 cms) and a Shore A durometer rating of 45A through 95A, the exercise rod will have a low resistance and an exercise carried out with the device will be essentially isotonic. On the other hand, if rod 14 is substantially stiffer, as in the case of a solid, round urethane rod of the same cross-sectional dimensions but having a Shore D rating of 45D through 70D, the exercise necessarily involves appreciable resistance to bending or twisting of the rod and hence is isometric in nature. In part, the isotonic or isometric character of the exercise is determined also by the length L1 of rod 14. If the length of exercise rod 14 is increased, it is easier to bend the rod and the exercise is more likely to be isotonic in character. For a relatively Short length L1, rod 14 may be quite stiff and exercise using the rod is more likely to be isometric.

Figure 3:
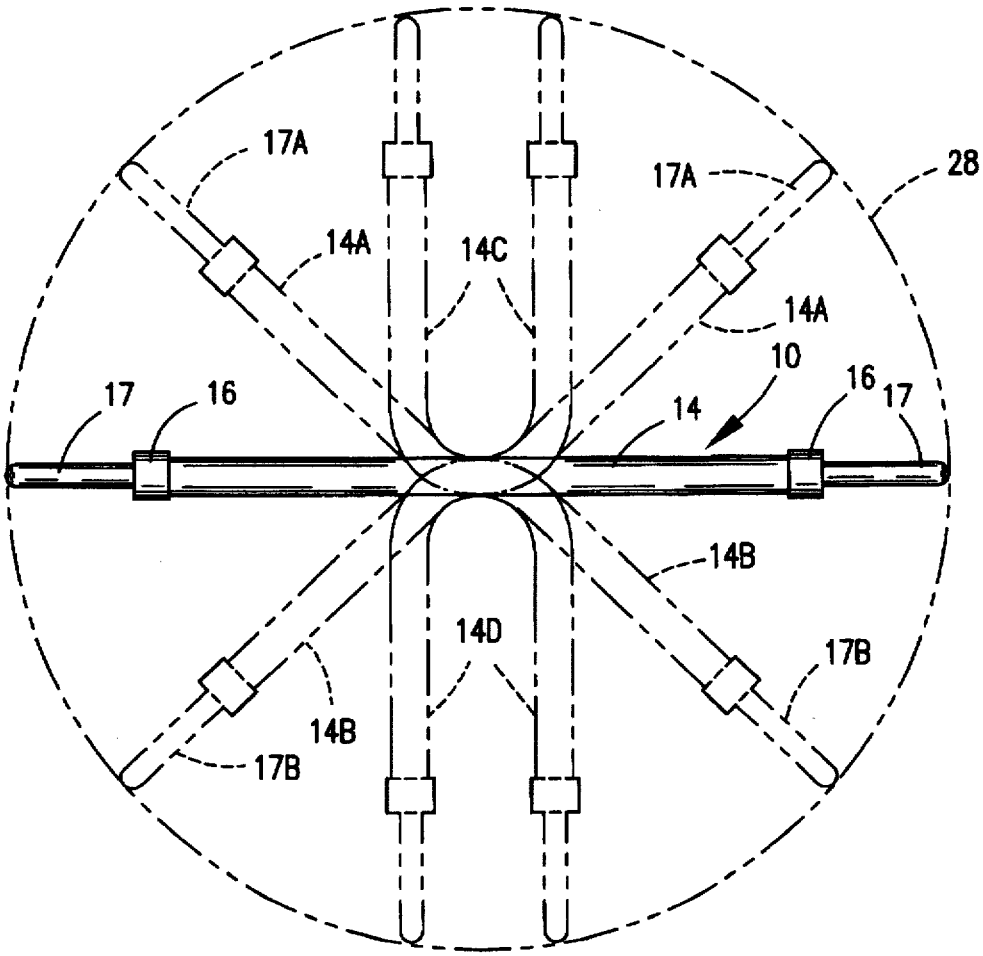
FIG. 3 is a motion diagram for the device of FIG. 1.

Referring to FIG. 3, it is seen that rod 14 can be bent upwardly to a phantom position 14A by the user, employing handles 17, deflecting the handles to positions 17A. In the opposite direction, rod 14 can be deflected to a phantom position 14B by moving the handles to positions 17B. The bend circle 28 in FIG. 1 shows the approximate limits of movement for the outer end of handle 17 in the course of deflection of rod 14 during physical therapy or exercise. The angular deflection of rod 14 is, of course, determined by the strength of the person carrying out the exercise and by the characteristics of rod 14. The upward-bend limit position for rod 14 is shown at 14C; the downward-bend limit is illustrated at 14D.

FIG. 3 shows the bend positions 14A–14D for exercise rod 14, effected by deflection of the rod using handles 17, in only one plane. However, there are numerous other positions to which rod 14 can be directed by use of handles 17. The limits of these different positions are generally as indicated by bend circle 28, but in other (not illustrated) planes.

To adapt device 10 for use by different individuals, who may have different impairments, it is a simple matter to change exercise rod 14. A different exercise rod 14 can be quickly substituted for the rod shown in FIGS. 1–3. The new exercise rod may have a greater or smaller length L1 and it may be formed from a stiffer material or from a less resistant material. The changeover of exercise rod 14 for adapting device 10 to use by a different person can be carried out in a matter of seconds. In any changeover, handles 17 and/or collars 16 may be used with the new rod. Alternatively, the new rod may have its own handles, so that no substitution is required.

Figure 4:
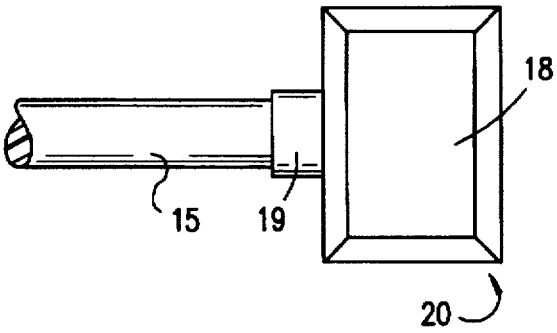
FIG. 4 is a detail view of an alternative for the device of FIGS. 1, with a different handle.

FIG. 4 is a detail illustration of a modification 20 of the previously described device 10. Device 20 includes a round, solid rod 15 of urethane or other bendable, twistable, resilient elastomer. Rod 15 is connected to a rectangular handle 18 by a collar 19. As in the previous embodiment, the elastomer rod 15 is the controlling element; it may be increased or decreased in length to have lower or higher resilience and resistance characteristics. A change of the elastomer of rod 15 can be utilized for the same purpose; with a stiffer elastomer the resilience and resistance of the rod increase, but a softer elastomer has the opposite result. In all other respects, the foregoing comments concerning device 10 are applicable to device 20; only the handles are different.

Figure 6:
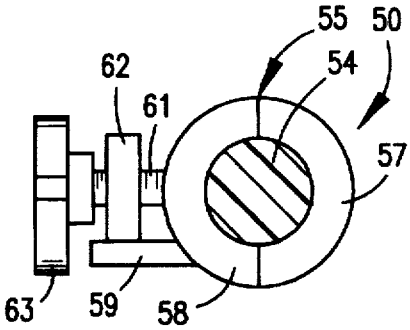
FIG. 6 is a section view taken approximately along line 6—6 in FIG. 5.
Figure 5:
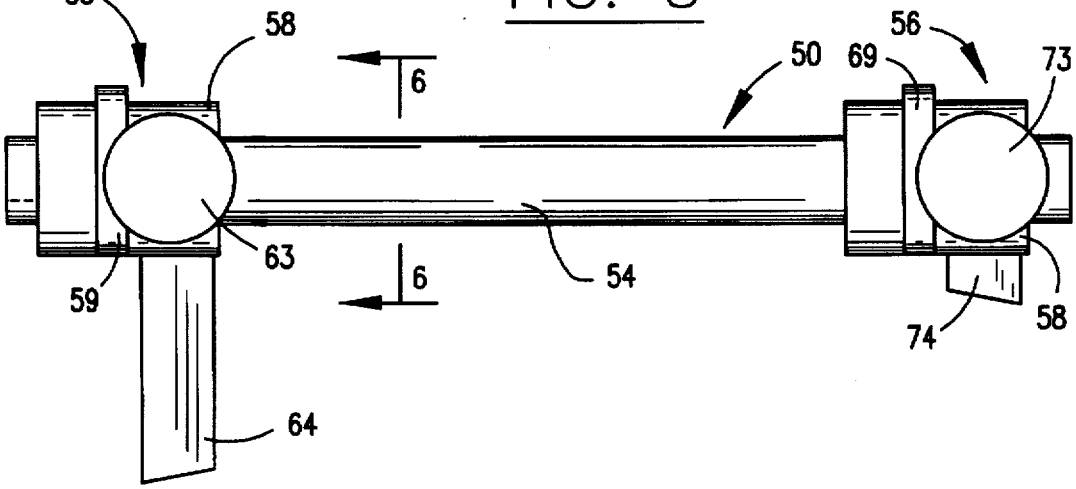
FIG. 5 is a side elevation view of an isotonic/isometric device employed in another embodiment of the invention.

FIGS. 5 and 6, in views similar to FIGS. 1 & 2, respectively, illustrate an isotonic/isometric physical therapy and exercise device 50 constructed for use in another embodiment of the present invention. Device 50 includes an elongated exercise rod 54 that may be similar in all respects to rods 14 and 15 of the previously described devices 10 and 20. In this instance, however, there are no handles like handles 17 (FIGS. 1–3) or 18 (FIG. 4). Instead, the opposite ends of rod 54 are engaged by two clamps 55 and 56. Clamp 55 comprises a fixed C-shaped clamp member 51 and a movable C-shaped clamp member 58; both clamp members are mounted on a clamp base 59.

A manually operable set screw 61 is threaded through a projection 62 that is part of clamp base 59. A tightening handle 63 is affixed to the outer end of set screw 61; turning handle 63 moves the set screw toward and away from clamp member 58 to tighten or loosen clamp 55 on rod 54. A strap 64, affixed to clamp base 59, completes clamp 55. Strap 64 may be made of a multi-hook fabric (VELCRO), or may include other fastener means. The other clamp 56, at the opposite end of rod 54, has the same construction as clamp 55; its base 69, handle 73, and strap 74 are shown in FIG. 5. Straps 64 and 74 may be quite short, as shown. Preferably, however longer straps are used. Each strap is in the form of a loop, for purposes to be described hereinafter.

Figure 7:
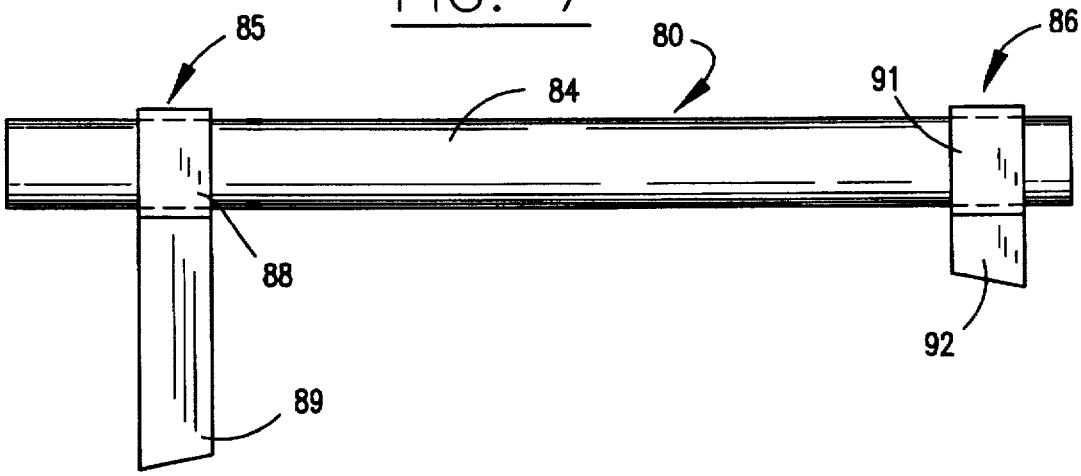
FIG. 7 is an elevation view, like FIG. 5, of a modified device employed in another embodiment of the invention.

FIG. 7 illustrates another isotonic/isometric exercise device 80 that can be used instead of the dual clamp device 50 of FIGS. 5 and 6. Device 80 comprises an elongated exercise rod 84 quite similar to rods 14, 24 and 54 of the previously described embodiments. Indeed, exercise rod 84 may be indistinguishable from rod 54; only the two "clamps" 85 and 86 on the opposite ends of rod 84 have been changed.

Thus, one end of rod 84 of device 80, the left end as seen in FIG. 7, is engaged in a pocket 88 that is sewn into a looped strap 89. The other end of rod 84 is held in a pocket 91 sewn into another looped strap 92. Device 80, FIG. 7 is lighter and less awkward than device 50 of FIGS. 5 and 6. However, more time and effort may be required for replacement of the elastomer rod 84 (FIG. 7) than the rod 54 (FIGS. 5 and 6).

Figure 8:
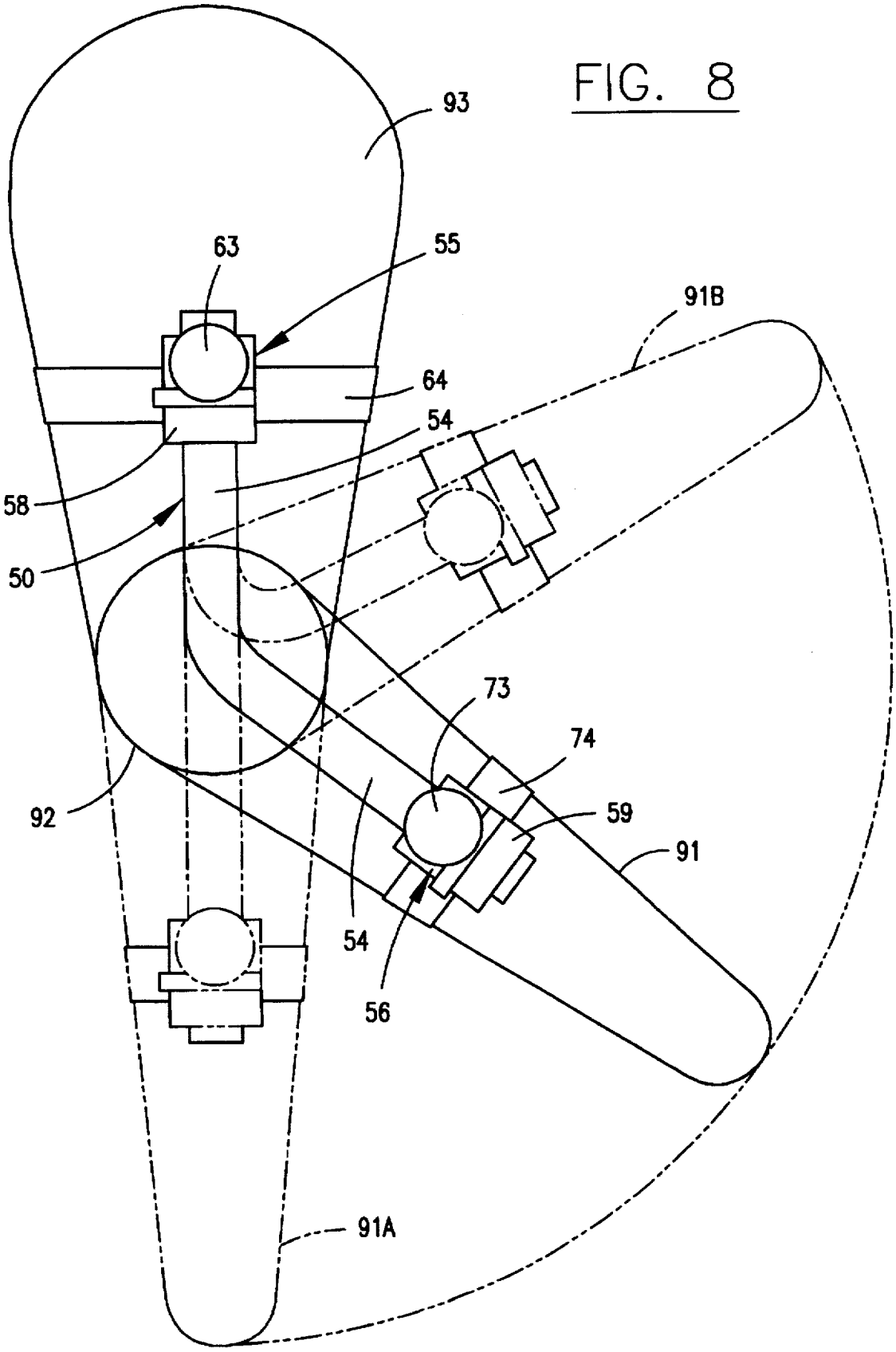
FIG. 8 is an elevation view, partly schematic, of the device of FIG. 5 applied to therapy for a knee, an elbow, a shoulder, a hip, or a wrist.

FIG. 8 shows device 50, FIGS. 5 and 6, as used for exercise or physical therapy for a user's elbow 92. Strap 64 of clamp 55 for device 50 encompasses the upper arm 93 of the user; elbow 92, upper arm 93, and forearm 91 are all shown schematically. Strap 64 is secured tightly to the user's upper arm to hold device 50 firmly in place. The other strap 74, which is a part of clamp 56 of device 50, encompasses the user's forearm 91, thus firmly securing the lower end of the exercise/therapy device 50 to the user's arm. There is no anchor at the joint, elbow 92.

The initial position for device 50, in FIG. 8, is as shown in solid lines in the drawing, with the resilient rod 54 bent at an obtuse angle (about 135°). In use, the forearm may swing between the lower phantom position 91A, with rod 54 straightened out, and the elevated phantom position 91B, with rod 54 bent at an acute angle (about 70°). The limiting positions 91A and 91B are likely to change, depending on the physical characteristics of the user such as strength, arm length, age, level of elbow impairment, etc. Moreover, it may be necessary or at least desirable to replace rod 54 one or more times with a stiffer rod as therapy progresses and the elbow 92 improves. Alternatively, the entire device 50 can be replaced for this purpose.

FIG. 8 is shown and described on the basis of exercise/therapy for an elbow, but applies equally to a leg and/or virtually any joint in the human anatomy. Thus, for an impaired knee requiring exercise, 93 may be deemed to represent the user's thigh (upper leg), 92 the impaired knee, and 91 the user's calf (lower leg). For an impaired hip, the sequence would be lower torso (93), hip (92) and thigh (91); for an impaired ankle it would be calf (93), ankle (92) and foot (91). If the user has an impaired shoulder, device 50 can be used on the basis of the sequence upper torso (93), shoulder (92) and upper arm (91); down at the user's wrist and sequence becomes lower arm (93), wrist (92) and hand (91). All that is required for the entire complement of joint injuries or impairments is the two clamps 55 and 56 and a plurality of resilient bendable rods 54 of appropriate lengths and varying resiliency and resistance characteristics.

Figure 9:
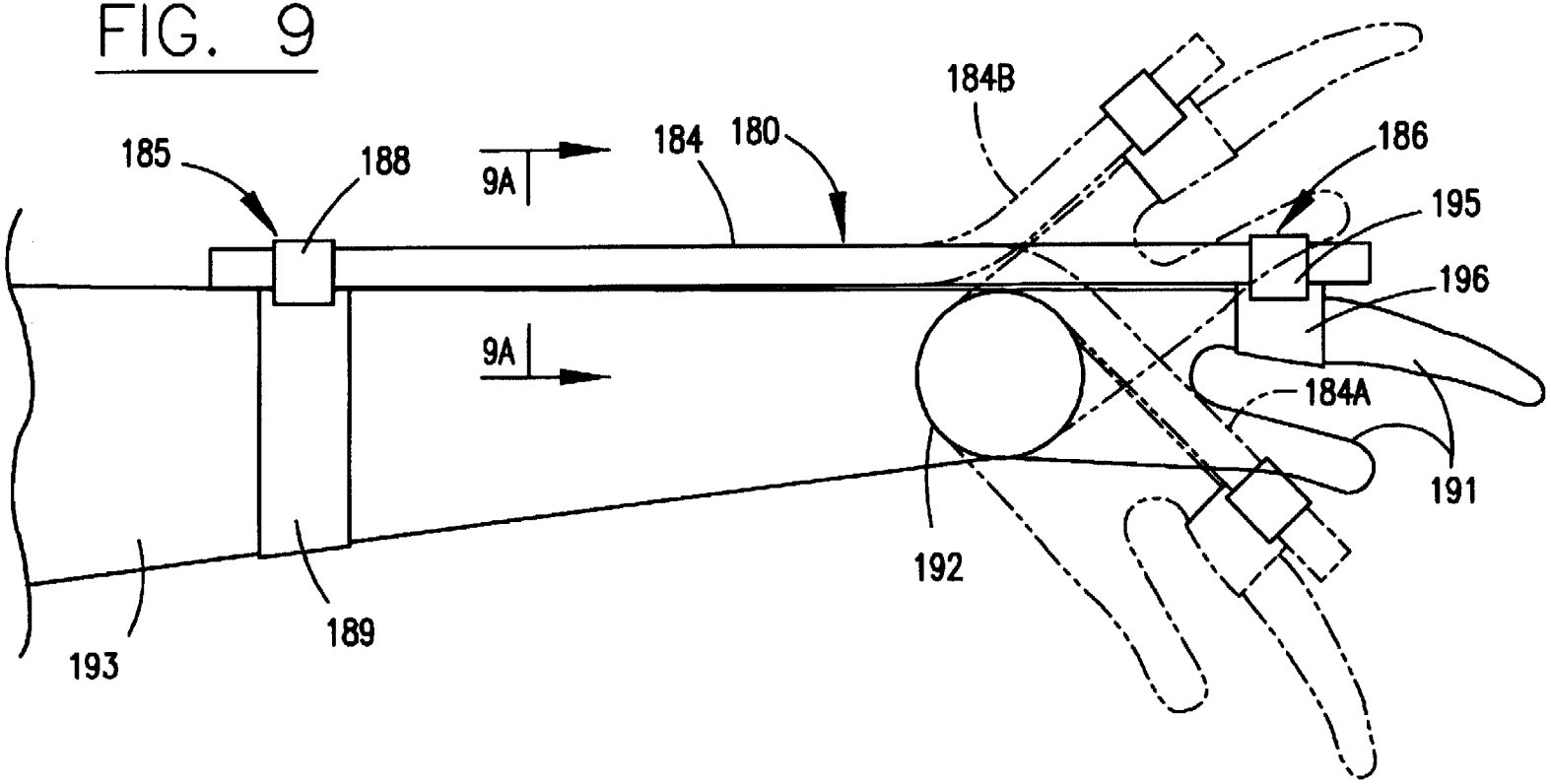
FIG. 9 is an elevation view, partly schematic, of a device like that of FIG. 7 applied to wrist therapy.
Figure 9A:
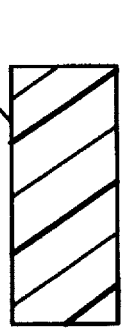
FIG. 9A is a section view taken approximately along line 9A—9A in FIG. 9.

FIG. 9 shows an exercise/therapy device 180, similar to device 80 of FIG. 7, as applied to exercise or physical therapy of a user's wrist 192. Device 180 includes an elongated, resilient, bendable and twistable rod 184. As shown in FIG. 9A, rod 184 is rectangular in cross section; it could be round or square or of virtually any other cross-sectional configuration.

At one end (the left-hand end in FIG. 9) of rod 184 there is a "clamp" 185 secured to the rod by a collar 188 to which a strap 189 is secured. Strap 189 is employed to secure this end of rod 184 to the forearm 193 of the user. At the other end of rod 184 there is another "clamp" 186 comprising a collar 195 that is secured to a strap 196. Strap 196 encompasses the hand 191 of the user and mounts the right-hand end of rod 184 to the user's hand.

In operation, the user bends wrist 192 down, deflecting the right-hand end of rod 184 toward phantom position 184A. The user also bends wrist 192 up to deflect this end of the rod toward phantom position 184B. As before, the actual limits of exercise movement may vary considerably, depending on the characteristics of the user and those of rod 184, particularly the rod length and resiliency. Moreover, rod 184 will usually be replaced, as the exercise/therapy progresses and wrist 192 improves, so that the resiliency and bendability of rod 184 matches the user's needs. Again, rod 184 itself may be replaced, with clamps 185 and 195 continuing in use, or the substitution may entail the entire device 180. It will be recognized that all of the devices 50 (FIGS. 5 and 8), 80 (FIG. 7) and 180 (FIG. 9) are effectively interchangeable and that other variations are readily effected.

Figure 10:
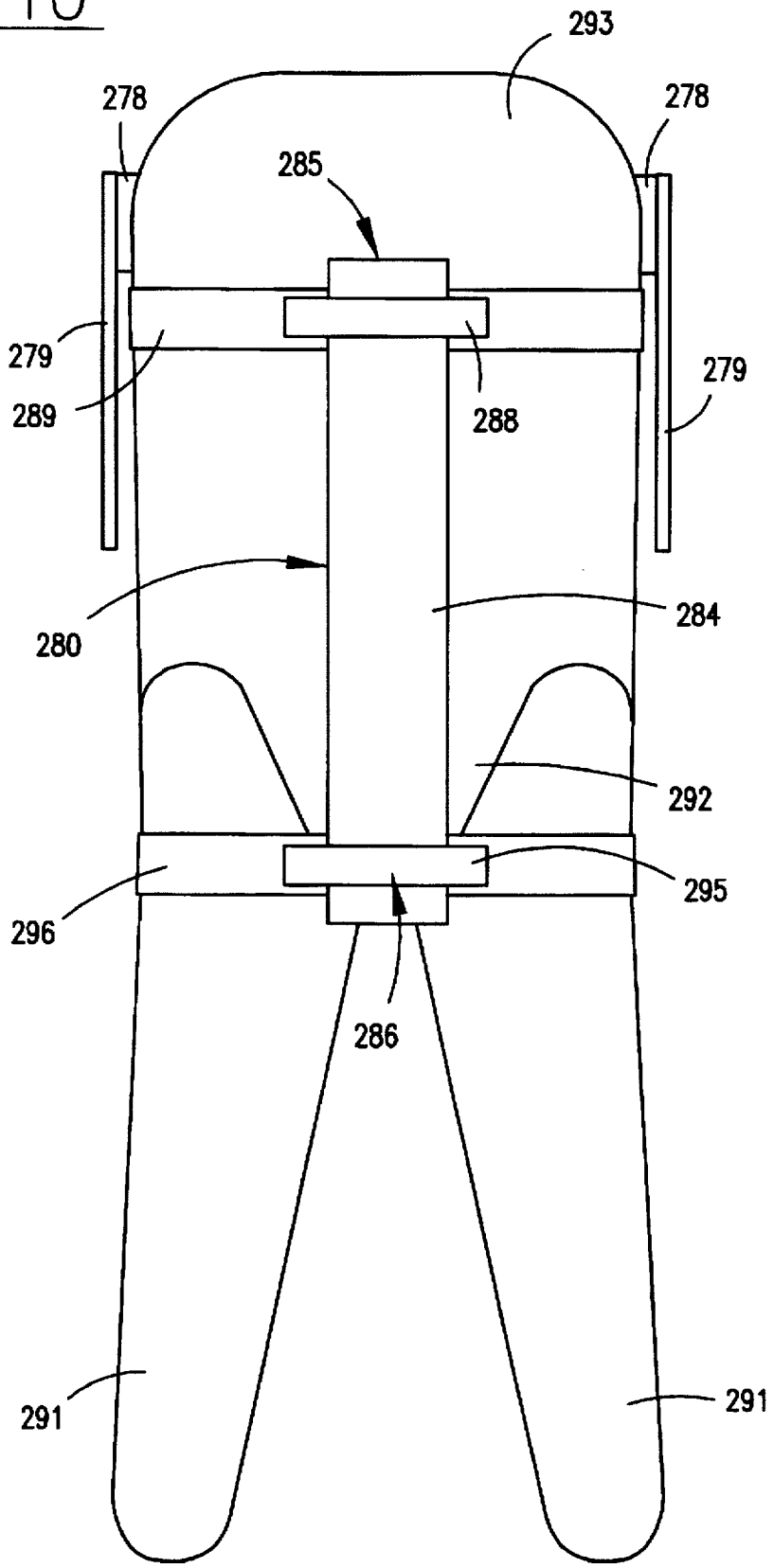
FIG. 10 is a rear elevation view, partly schematic, of a device used for back exercise or therapy, using a further embodiment of the invention.
Figure 11:
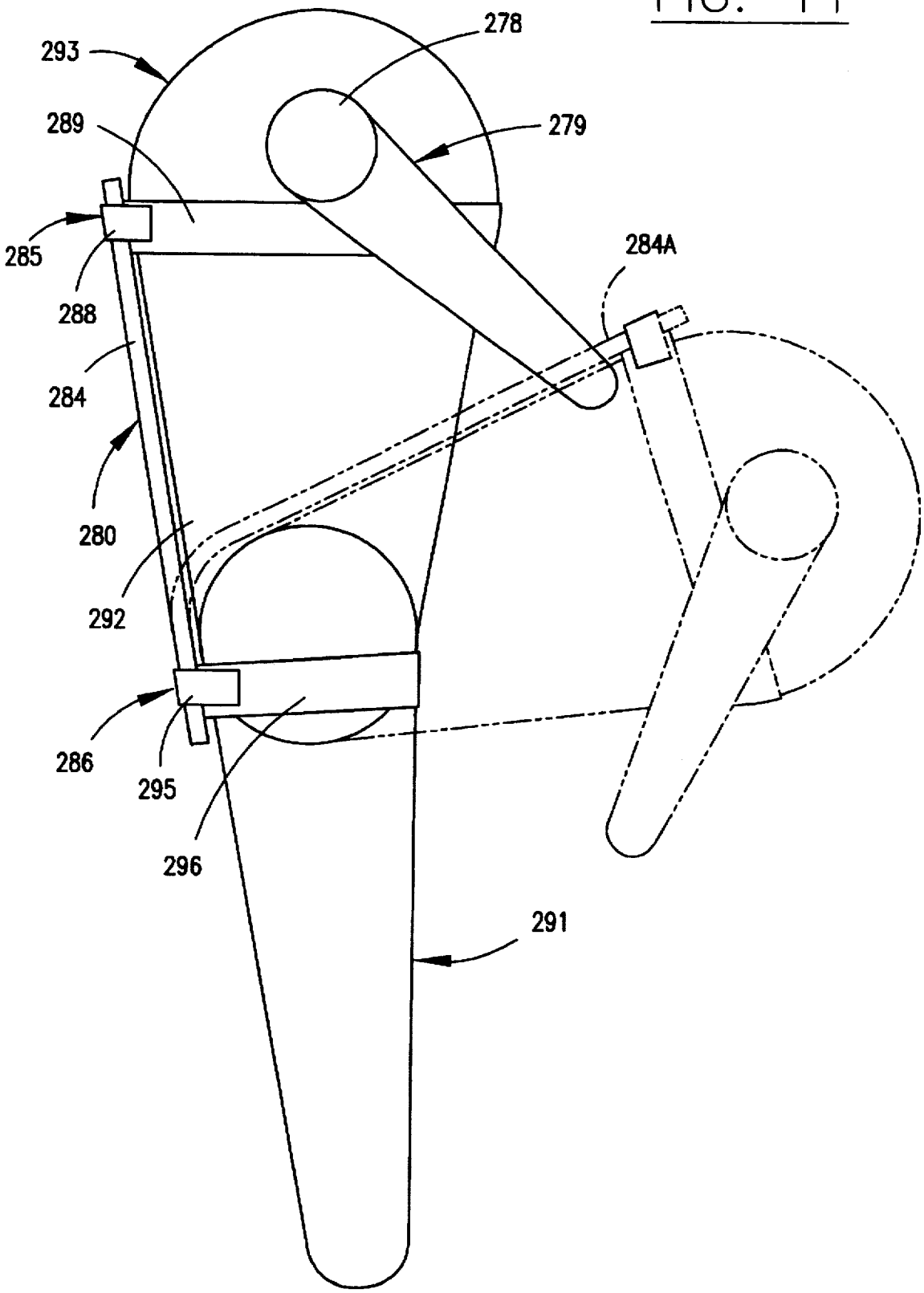
FIG. 11 is a side elevation view, partly schematic, of the apparatus of FIG. 10.

FIGS. 10 and 11 illustrate the use of a device 280 for exercise/therapy for an impairment of the user's lower back 292, adjacent the top of the user's hips. Device 280 includes an elongated, flat, resilient, bendable and twistable plate or bar 284, preferably molded or otherwise formed of urethane. Other elastomers may be used as desired.

The upper end of bar 284 is affixed to a "clamp" 285 comprising a collar or pocket 288. Pocket 288 is secured a strap 289 that passes around the upper torso 293 of the user. As shown, strap 289 encircles the user's upper torso 293 immediately below the user's shoulders 278, so that there is no interference with the user's arms 279. The lower end of bar 284 is affixed to a "clamp" 286 that includes a collar or pocket 295. Pocket 295 is secured to a strap 296 that, in FIGS. 10 and 11, extends around the hips of the user, at the top of the user's thighs 291.

For the starting position shown in solid lines in FIGS. 10 and 11, the resilient, bendable bar (rod) 284 is essentially straight. In this exercise, the user bends forwardly at the waist, to the position shown in phantom lines in FIG. 11, with bar 284 bent to position 284A. The actual limit of movement will vary, again in accordance with the physical characteristics of the person using the exercise/therapy device 280 and the characteristics of its principal operating component, bar 284. Some backward bending (counterclockwise as seen in FIG. 11) and/or some lateral bending (left or right as seen in FIG. 10) may also occur, depending on the nature of the impairment to which the user is subject. As the user gains (or regains) back strength, replacement of bar 284 (or of the entire device 28) is usually desirable.

I claim:

1. An isotonic/isometric physical therapy and exercise device for therapy exercises by a human being which exercises entail bending or twisting, the physical therapy and exercise device comprising:

an elongated, resilient, bendable and twistable exercise rod formed of an elastomer;

a first clamp mounted on one end of the rod, the first clamp including first securing means for securing the one end of the rod to the anatomy of a human user at a location on one side of an impairment;

and a second clamp mounted on the other end of the rod, the second clamp including second securing means for securing the other end of the rod to the anatomy of the human user at a location on the other side of the impairment.

2. A physical therapy and exercise device according to claim 1 in which each clamp is removably mounted on an end of the exercise rod so that the two clamps can be removed from the rod and mounted on the ends of a different exercise rod.

3. A physical therapy and exercise device according to claim 1 in which the first clamp includes two clamp members movable toward and away from each other, and a clamp applying member for moving the clamp members toward and away from each other.

4. A physical therapy and exercise device according to claim 1 in which the first securing means is an extensible, flexible band.

5. A physical therapy and exercise device according to claim 4 in which the first clamp is mounted on the one end of the rod by a loop of the extensible band, which band encompasses the one end of the rod in closely fitting relation thereto.

* * * * *